US006955419B2

(12) United States Patent
Andrews et al.

(10) Patent No.: US 6,955,419 B2
(45) Date of Patent: Oct. 18, 2005

(54) INK JET APPARATUS

(75) Inventors: John R. Andrews, Fairport, NY (US); Cathie J. Burke, Rochester, NY (US); Peter J. Nystrom, Webster, NY (US); Richard Schmachtenberg, III, Aloha, OR (US)

(73) Assignee: Xerox Corporation, Stamford, CT (US)

( * ) Notice: Subject to any disclaimer, the term of this patent is extended or adjusted under 35 U.S.C. 154(b) by 174 days.

(21) Appl. No.: 10/702,935

(22) Filed: Nov. 5, 2003

(65) Prior Publication Data

US 2005/0093930 A1 May 5, 2005

(51) Int. Cl.[7] ..... B41J 2/045
(52) U.S. Cl. ..... 347/70; 347/68
(58) Field of Search ..... 347/68, 70, 71, 347/72, 55–57, 59, 61–62

(56) References Cited

U.S. PATENT DOCUMENTS 4,516,140 A 5/1985 Durkee et al.
5,658,471 A * 8/1997 Murthy et al. ..... 216/27
6,532,028 B1 3/2003 Gailus et al.
6,785,956 B2 * 9/2004 Xu et al. ..... 29/611
6,796,638 B2 * 9/2004 Koike et al. ..... 347/70
6,880,920 B2 * 4/2005 Murai ..... 347/70

FOREIGN PATENT DOCUMENTS

EP 0 733 480 A 9/1996

OTHER PUBLICATIONS

Examiner M. Bardet, European Patent Office, European Search Report for Application No. EP 04026225, Feb. 9, 2005, 3 pages, Search performed in The Hague.
U.S. Appl. No. 10/664,472, filed Sep. 16, 2003, Buhler et al.

* cited by examiner

*Primary Examiner*—K. Feggins
(74) *Attorney, Agent, or Firm*—Manuel Quiogue

(57) ABSTRACT

A drop emitting apparatus including a diaphragm layer disposed on a fluid channel layer, a thin film circuit having raised contact regions disposed on the diaphragm layer, and a plurality of electromechanical transducers conductively attached to the raised contact regions.

25 Claims, 3 Drawing Sheets

INK JET APPARATUS

BACKGROUND OF THE DISCLOSURE

The subject disclosure is generally directed to drop emitting apparatus, and more particularly to ink jet apparatus.

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented in a printhead or a printhead assembly. For example, the printhead assembly and the receiver surface are caused to move relative to each other, and drop generators are controlled to emit drops at appropriate times, for example by an appropriate controller. The receiver surface can be a transfer surface or a print medium such as paper. In the case of a transfer surface, the image printed thereon is subsequently transferred to an output print medium such as paper.

A known ink jet printhead structure employs electromechanical transducers that are attached to a metal diaphragm plate, and it can be difficult to make electrical connections to the electromechanical transducers.

DETAILED DESCRIPTION OF THE DISCLOSURE

Figure 1:
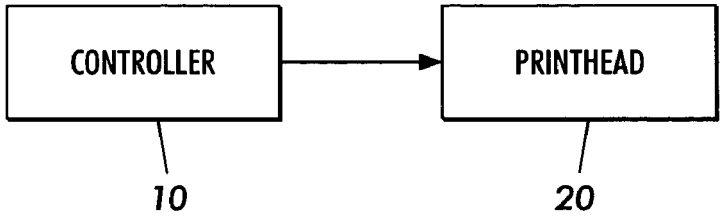
FIG. 1 is a schematic block diagram of an embodiment of a drop-on-demand drop emitting apparatus.

FIG. 1 is a schematic block diagram of an embodiment of a drop-on-demand printing apparatus that includes a controller 10 and a printhead assembly 20 that can include a plurality of drop emitting drop generators. The controller 10 selectively energizes the drop generators by providing a respective drive signal to each drop generator. Each of the drop generators can employ a piezoelectric transducer such as a ceramic piezoelectric transducer. As other examples, each of the drop generators can employ a shear-mode transducer, an annular constrictive transducer, an electrostrictive transducer, an electromagnetic transducer, or a magnetorestrictive transducer. The printhead assembly 20 can be formed of a stack of laminated sheets or plates, such as of stainless steel.

Figure 2:
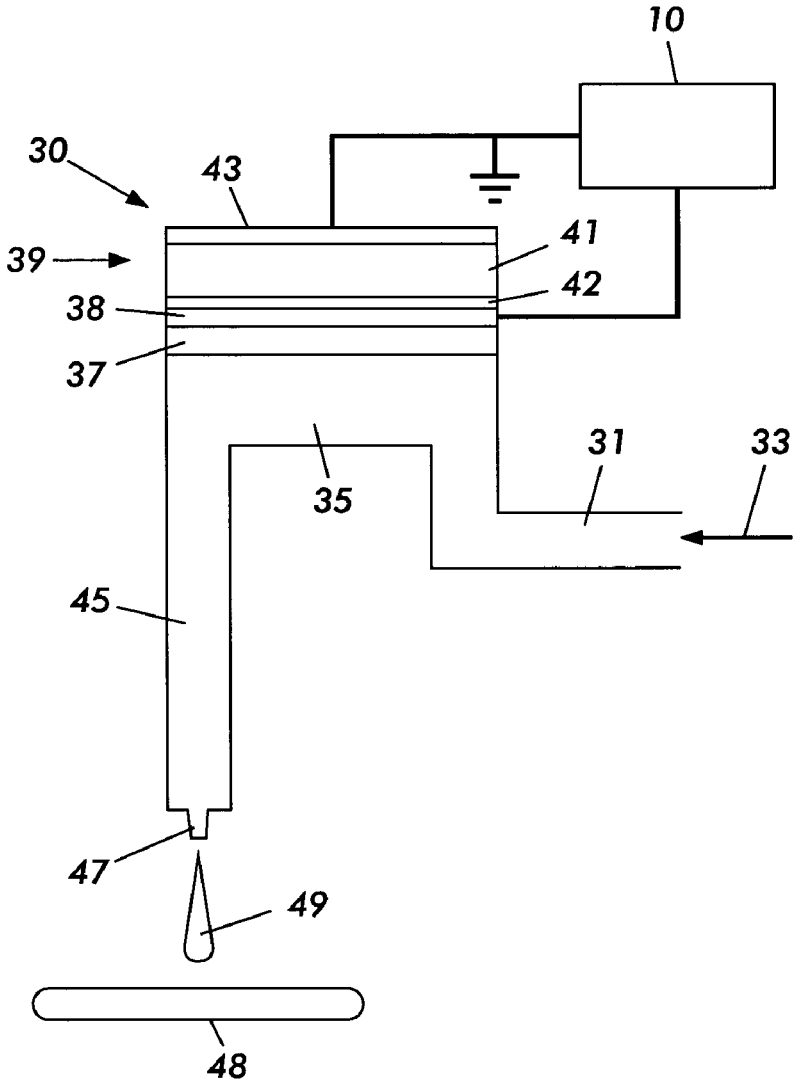
FIG. 2 is a schematic block diagram of an embodiment of a drop generator that can be employed in the drop emitting apparatus of FIG. 1.

FIG. 2 is a schematic block diagram of an embodiment of a drop generator 30 that can be employed in the printhead assembly 20 of the printing apparatus shown in FIG. 1. The drop generator 30 includes an inlet channel 31 that receives ink 33 from a manifold, reservoir or other ink containing structure. The ink 33 flows into a pressure or pump chamber 35 that is bounded on one side, for example, by a flexible diaphragm 37. A thin-film interconnect structure 38 is attached to the flexible diaphragm, for example so as to overlie the pressure chamber 35. An electromechanical transducer 39 is attached to the thin film interconnect structure 38. The electromechanical transducer 39 can be a piezoelectric transducer that includes a piezo element 41 disposed for example between electrodes 42 and 43 that receive drop firing and non-firing signals from the controller 10 via the thin-film interconnect structure 38, for example. The electrode 43 is connected to ground in common with the controller 10, while the electrode 42 is actively driven to actuate the electromechanical transducer 41 through the interconnect structure 38. Actuation of the electromechanical transducer 39 causes ink to flow from the pressure chamber 35 to a drop forming outlet channel 45, from which an ink drop 49 is emitted toward a receiver medium 48 that can be a transfer surface, for example. The outlet channel 45 can include a nozzle or orifice 47.

The ink 33 can be melted or phase changed solid ink, and the electromechanical transducer 39 can be a piezoelectric transducer that is operated in a bending mode, for example.

Figure 3:
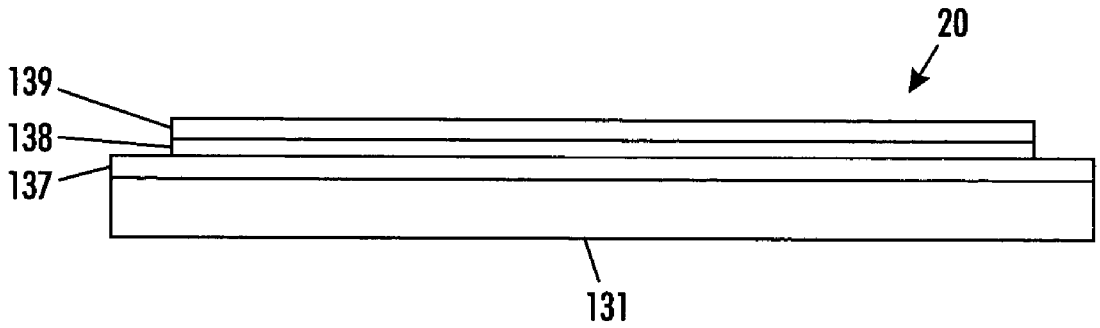
FIG. 3 is a schematic elevational view of an embodiment of an ink jet printhead assembly.

FIG. 3 is a schematic elevational view of an embodiment of an ink jet printhead assembly 20 that can implement a plurality of drop generators 30 (FIG. 2), for example as an array of drop generators. The ink jet printhead assembly includes a fluid channel layer or substructure 131, a diaphragm layer 137 attached to the fluid channel layer 131, a thin-film interconnect circuit layer 138 disposed on the diaphragm layer 137 and a transducer layer 139 attached to the thin-film interconnect circuit layer 138. The fluid channel layer 131 implements the fluid channels and chambers of the drop generators 30, while the diaphragm layer 137 implements the diaphragms 37 of the drop generators. The thin-film interconnect circuit layer 138 implements the interconnect circuits 38, while the transducer layer 139 implements the electromechanical transducers 39 of the drop generators 30.

By way of illustrative example, the diaphragm layer 137 comprises a metal plate or sheet such as stainless steel that is attached or bonded to the fluid channel layer 131. The diaphragm layer 137 can also comprise an electrically non-conductive material such as a ceramic. Also by way of illustrative example, the fluid channel layer 131 can comprise multiple laminated plates or sheets. The transducer layer 139 can comprise an array of kerfed ceramic transducers that are attached or bonded to the thin film interconnect circuit layer 138, for example with an epoxy adhesive.

Figure 4:
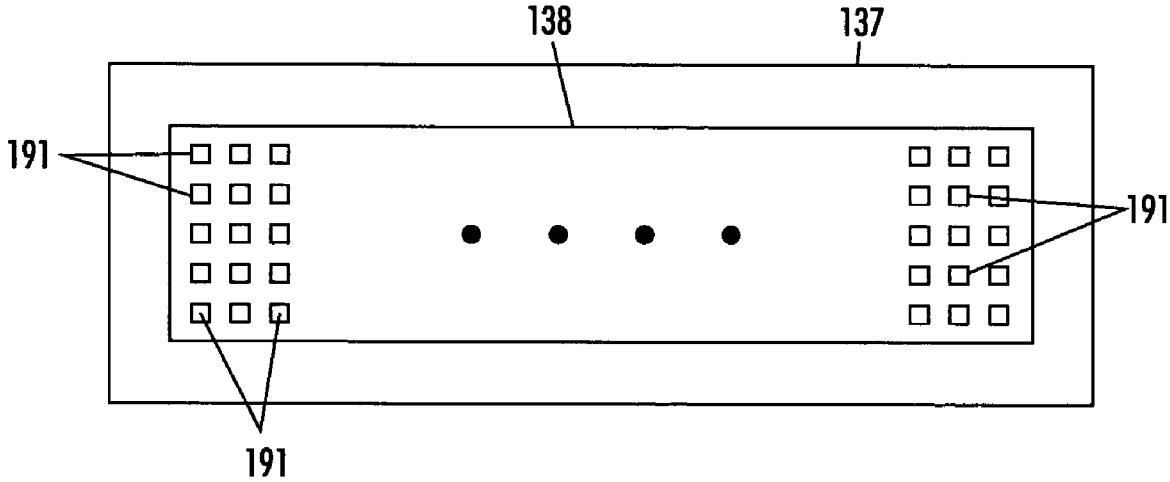
FIG. 4 is a schematic plan view of an embodiment of a thin film interconnect circuit of the ink jet printhead assembly of FIG. 3.

FIG. 4 is a schematic plan view of an embodiment of a thin film interconnect circuit layer 138 that includes raised contact pads or regions 191. The electromechanical transducers 39 (FIGS. 5–7) are conductively attached to respective raised contact pads 191, for example with conductive adhesive or a low temperature solder. As disclosed in various embodiments illustrated in FIGS. 5–7, the raised contact regions 191 can be formed by a thin film structure that can include for example a mesa layer and a patterned conductive layer. The thin film interconnect circuit 138 can provide for electrical interconnection to the individual electromechanical transducers 39.

Figure 5:
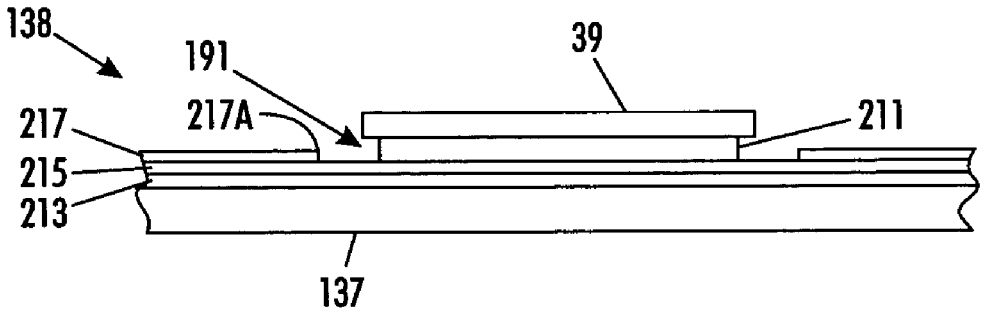
FIG. 5 is a schematic elevational sectional view of a portion of another embodiment of a thin film interconnect circuit of the ink jet printhead assembly.

FIG. 5 is a schematic elevational sectional view of a portion of a further embodiment of a thin film interconnect circuit layer 138 that can be used with an electrically conductive or non-conductive diaphragm layer 137. The thin film interconnect circuit layer 138 includes a blanket dielectric layer 213, a patterned conductive layer 215 disposed on the blanket dielectric layer 213, and a conductive mesa layer 211 comprising a plurality of conductive mesas overlying the patterned conductive layer 215. The conductive mesas and the underlying portions of the conductive layer 215 form raised contact regions or pads 191. The interconnect circuit layer 138 can further include a patterned dielectric layer 217 having openings 217A through which the raised contact pads 191 extend. The raised contact pads 191 are higher than the other layers of the interconnect circuit layer 138, and comprise the highest portions of the interconnect circuit layer 138. This facilitates the attachment of an electromechanical transducer 39 to each of the raised contact pads 191.

In the embodiment schematically depicted in FIG. 5, the patterned mesa layer 211 can comprise a suitably patterned metal layer, and the patterned conductive layer 215 can also comprise a suitably patterned metal layer, for example.

Figure 6:
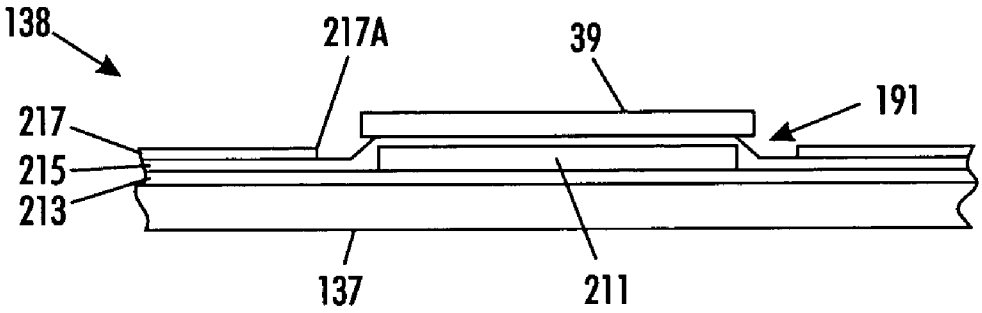
FIG. 6 is a schematic elevational sectional view of a portion of a further embodiment of a thin film interconnect circuit of the ink jet printhead assembly.

FIG. 6 is a schematic elevational sectional view of a portion of a further embodiment of a thin film interconnect circuit layer 138 that can be used with an electrically conductive or non-conductive diaphragm 137. The interconnect circuit layer 138 includes a blanket dielectric layer 213, a mesa layer 211 comprising a plurality of mesas overlying the blanket dielectric layer 213, and a patterned conductive layer 215 overlying the mesa layer 211. The mesa layer 211 can be electrically non-conductive (e.g., dielectric) or conductive (e.g., metal). The mesas and the overlying portions of the patterned conductive layer 215 form raised contact regions or pads 191. The thin film interconnect circuit layer 138 can further include a patterned dielectric layer 217 having openings 217A through which the raised contact pads 191 extend. The raised contact pads 191 are higher than the other layers of the interconnect circuit layer 138, and comprise the highest portions of the interconnect layer 138. This facilitates the attachment of an electromechanical transducer 39 to each of the raised contact pads 191.

In the embodiment schematically depicted in FIG. 6, the mesa layer 211 can comprise a suitably patterned dielectric layer or metal layer, for example. The patterned conductive layer 215 can comprise a patterned metal layer.

Figure 7:
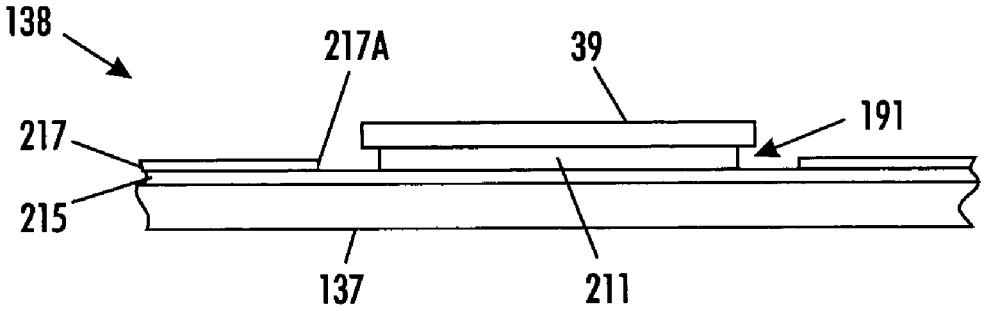
FIG. 7 is a schematic elevational sectional view of a portion of another embodiment of a thin film interconnect circuit of the ink jet printhead assembly.

FIG. 7 is a schematic elevational sectional view of a portion of a further embodiment of a thin film interconnect circuit layer 138 that can be used with an electrically non-conductive diaphragm layer 137. The thin film interconnect circuit layer 138 includes a patterned conductive layer 215 and a conductive mesa layer 211 comprising a plurality of mesas overlying the patterned conductive layer 215. The conductive mesas and the underlying portions of the patterned conductive layer 215 form raised contact regions or pads 191. The thin film interconnect circuit layer 138 can further include a patterned dielectric layer 217 having openings 217A through which the raised contact pads 191 extend. The raised contact pads 191 are higher than the other layers of the thin film interconnect circuit layer 138, and comprise the highest portions of the interconnect layer 138. This facilitates the attachment of an electromechanical transducer 39 to each of the raised contact pads 191.

In the embodiment schematically depicted in FIG. 7, the patterned conductive mesa layer 211 can comprise a suitably patterned metal layer, and the patterned conductive layer 215 can also comprise a suitably patterned metal layer, for example.

Each dielectric layer of the thin film interconnect circuit layer 138 can comprise silicon oxide, silicon nitride, or silicon oxynitride, for example, and can have a thickness in the range of about 0.1 micrometers of about 5 micrometers. More specifically, each dielectric layer can have a thickness in the range of about 1 micrometers to about 2 micrometers.

Each conductive layer of the thin film interconnect circuit layer 138 can comprise aluminum, chromium, nickel, tantalum or copper, for example, and can have a thickness in the range of about 0.1 micrometers of about 5 micrometers. More specifically, each conductive layer can have a thickness in the range of about 1 micrometers to about 2 micrometers.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop emitting apparatus comprising:
- a fluid channel layer;
- a diaphragm layer disposed on the fluid channel layer;
- a blanket dielectric layer disposed on the diaphragm layer;
- a thin film circuit having raised contact regions disposed on the blanket dielectric layer; and
- a plurality of electromechanical transducers conductively attached to the raised contact regions.

2. The drop emitting apparatus of claim 1 wherein the raised contact regions include dielectric mesas.

3. The drop emitting apparatus of claim 1 wherein the raised contact regions include conductive mesas.

4. The drop emitting apparatus of claim 1 wherein the thin film circuit comprises a mesa layer and a patterned conductive layer overlying the mesa layer.

5. The drop emitting apparatus of claim 1 wherein the fluid channel layer receives melted solid ink.

6. The drop emitting apparatus of claim 1 wherein the electromechanical transducers comprise piezoelectric transducers.

7. The drop emitting apparatus of claim 1 wherein the fluid channel layer comprises a stack of patterned metal plates.

8. A drop emitting apparatus comprising:
- a fluid channel layer;
- a dielectric diaphragm layer attached to the fluid channel layer;
- a patterned conductive layer disposed on the dielectric diaphragm layer;
- a plurality of conductive mesas disposed on the patterned conductive layer; and
- a plurality of piezoelectric transducers conductively attached to the conductive mesas.

9. The drop emitting apparatus of claim 8 wherein the fluid channel layer receives melted solid ink.

10. The drop emitting apparatus of claim 8 wherein the electromechanical transducers comprise piezoelectric transducers.

11. The drop emitting apparatus of claim 8 wherein the fluid channel layer comprises a stack of patterned metal plates.

12. A drop emitting apparatus comprising:
- a fluid channel layer;
- a metal diaphragm layer disposed on the fluid channel layer;
- a blanket dielectric layer disposed on the diaphragm layer;
- a patterned conductive layer disposed on the blanket dielectric layer;
- a plurality of conductive mesas disposed on the patterned conductive layer; and a plurality of electromechanical transducers conductively attached to the conductive mesas.

13. The drop emitting apparatus of claim 12 wherein the fluid channel layer receives melted solid ink.

14. The drop emitting apparatus of claim 12 wherein the electromechanical transducers comprise piezoelectric transducers.

15. The drop emitting apparatus of claim 12 wherein the fluid channel layer comprises a stack of patterned metal plates.

16. A drop generator comprising:

a pressure chamber;

a diaphragm forming a wall of the pressure chamber;

a dielectric layer disposed on the diaphragm;

a thin film raised contact region disposed on the dielectric layer;

a piezoelectric transducer conductively attached to the raised contact region;

an outlet channel connected to the pressure chamber; and a drop emitting nozzle disposed at an end of the outlet channel.

17. The drop generator of claim 16 wherein the raised contact region includes a dielectric mesa.

18. The drop generator of claim 16 wherein the raised contact region includes a conductive mesa.

19. The drop generator of claim 16 wherein the raised contact region comprises a mesa disposed on the dielectric layer and a conductive layer on the mesa.

20. The drop generator of claim 16 wherein the raised contact region comprises a conductive layer disposed on the dielectric layer and a conductive mesa disposed on the conductive layer.

21. The drop generator of claim 16 wherein the pressure chamber receives melted solid ink.

22. The drop generator of claim 16 wherein the pressure chamber and the outlet channel are formed in a stack of patterned metal plates.

23. A drop generator comprising:

a pressure chamber;

a dielectric diaphragm forming a wall of the pressure chamber;

a patterned conductive layer disposed on the dielectric diaphragm;

a conductive mesa disposed on the patterned conductive layer;

a piezoelectric transducer conductively attached to the conductive mesa;

an outlet channel connected to the pressure chamber; and a drop emitting nozzle disposed at an end of the outlet channel.

24. The drop generator of claim 23 wherein the pressure chamber receives melted solid ink.

25. The drop generator of claim 23 wherein the pressure chamber and the outlet channel are formed in a stack of patterned metal plates.

* * * * *